US010734708B2

(12) United States Patent
Yong et al.

(10) Patent No.: US 10,734,708 B2
(45) Date of Patent: Aug. 4, 2020

(54) ANTENNAS FORMED FROM CONDUCTIVE DISPLAY LAYERS

(71) Applicant: Apple Inc., Cupertino, CA (US)

(72) Inventors: Siwen Yong, San Francisco, CA (US); Yi Jiang, Cupertino, CA (US); Jiangfeng Wu, San Jose, CA (US); Lijun Zhang, San Jose, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 98 days.

(21) Appl. No.: 16/032,948

(22) Filed: Jul. 11, 2018

(65) Prior Publication Data

US 2020/0021008 A1 Jan. 16, 2020

(51) Int. Cl.
*H01Q 1/24* (2006.01)
*H01Q 21/00* (2006.01)

(52) U.S. Cl.
CPC ..... *H01Q 1/243* (2013.01); *H01Q 21/005* (2013.01)

(58) Field of Classification Search
CPC ..... H01G 1/243; H01G 21/005; H01Q 1/38; G06F 3/041; G06F 3/044
See application file for complete search history.

(56) References Cited

U.S. PATENT DOCUMENTS

2012/0162128 A1* 6/2012 Hyoung ..... G06F 3/044 345/174
2012/0287018 A1* 11/2012 Parsche ..... H01Q 1/243 343/897
2013/0038565 A1 2/2013 Elloway et al.
2014/0106684 A1 4/2014 Burns et al.
2015/0084907 A1* 3/2015 Burberry ..... G06F 3/046 345/174
2015/0255856 A1* 9/2015 Hong ..... H01Q 1/243 343/702
2016/0093939 A1* 3/2016 Kim ..... H01Q 1/243 343/720

* cited by examiner

*Primary Examiner* — Dameon E Levi
*Assistant Examiner* — David E Lotter
(74) *Attorney, Agent, or Firm* — Treyz Law Group, P.C.; Michael H. Lyons

(57) ABSTRACT

An electronic device such as a wristwatch may be provided with wireless circuitry and a display having a display module and a cover layer. The display module may include a dielectric layer. Touch sensor electrodes may be formed from conductive traces on the dielectric layer. An antenna may be embedded within the display module. The antenna may include an antenna resonating element formed from a grid of intersecting conductive traces on the dielectric layer. The grid may have edges that define a lateral outline of the antenna resonating element. The outline may have a length that configures the antenna to radiate at a desired frequency. The antenna resonating element may be formed from indium tin oxide and may be substantially transparent.

18 Claims, 11 Drawing Sheets

ANTENNAS FORMED FROM CONDUCTIVE DISPLAY LAYERS

BACKGROUND

This relates generally to electronic devices and, more particularly, to electronic devices with wireless communications circuitry.

Electronic devices often include wireless circuitry with antennas. For example, cellular telephones, computers, and other devices often contain antennas for supporting wireless communications.

It can be challenging to form electronic device antenna structures with desired attributes. In some wireless devices, the presence of conductive structures such as conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures.

It would therefore be desirable to be able to provide improved wireless communications circuitry for wireless electronic devices.

SUMMARY

An electronic device such as a wristwatch may be provided with wireless circuitry. The electronic device may have a display with a display module and a display cover layer overlapping the display module. The display module may include stacked dielectric layers. Display circuitry such as pixel circuitry and touch sensor electrodes may be formed on the stacked dielectric layers.

The wireless circuitry may include an antenna embedded within the display module. The antenna may have an antenna resonating element such as a patch antenna resonating element. The antenna resonating element may be formed from a conductive layer on one of the dielectric layers. The conductive layer may include a grid of intersecting conductive traces that form the antenna resonating element. The grid may have edges that define a lateral outline of the antenna resonating element. The outline may have a length that configures the antenna to radiate at a desired frequency. The grid may include segments of conductive traces that surround an array of slots within the antenna resonating element. The slots may each have a length between 0.1 mm and 5.0 mm. The segments may each have a width between 0.01 mm and 0.20 mm. The antenna may include a ground plane formed on an additional dielectric layer below the antenna resonating element. The ground plane may include a grid of intersecting conductive traces.

The antenna resonating element may be fed using a conductive via extending through the dielectric layer. In another suitable arrangement, the antenna is fed using a transmission line on a flexible printed circuit coupled to the display module. The flexible printed circuit may carry conductive traces coupled to the touch sensor electrodes in the display module. In yet another suitable arrangement, the antenna may be fed using an indirect feed element embedded in the display module. The antenna may radiate through the display cover layer.

Touch sensor electrodes may be formed on the same dielectric layer as the antenna resonating element. The grid of conductive traces and the touch sensor electrodes may be formed from indium tin oxide (ITO). The antenna resonating element may be substantially transparent or invisible to view by a user of the device. The antenna may be embedded in other dielectric substrates mounted to other dielectric cover layers in the device if desired.

DETAILED DESCRIPTION

Figure 1:
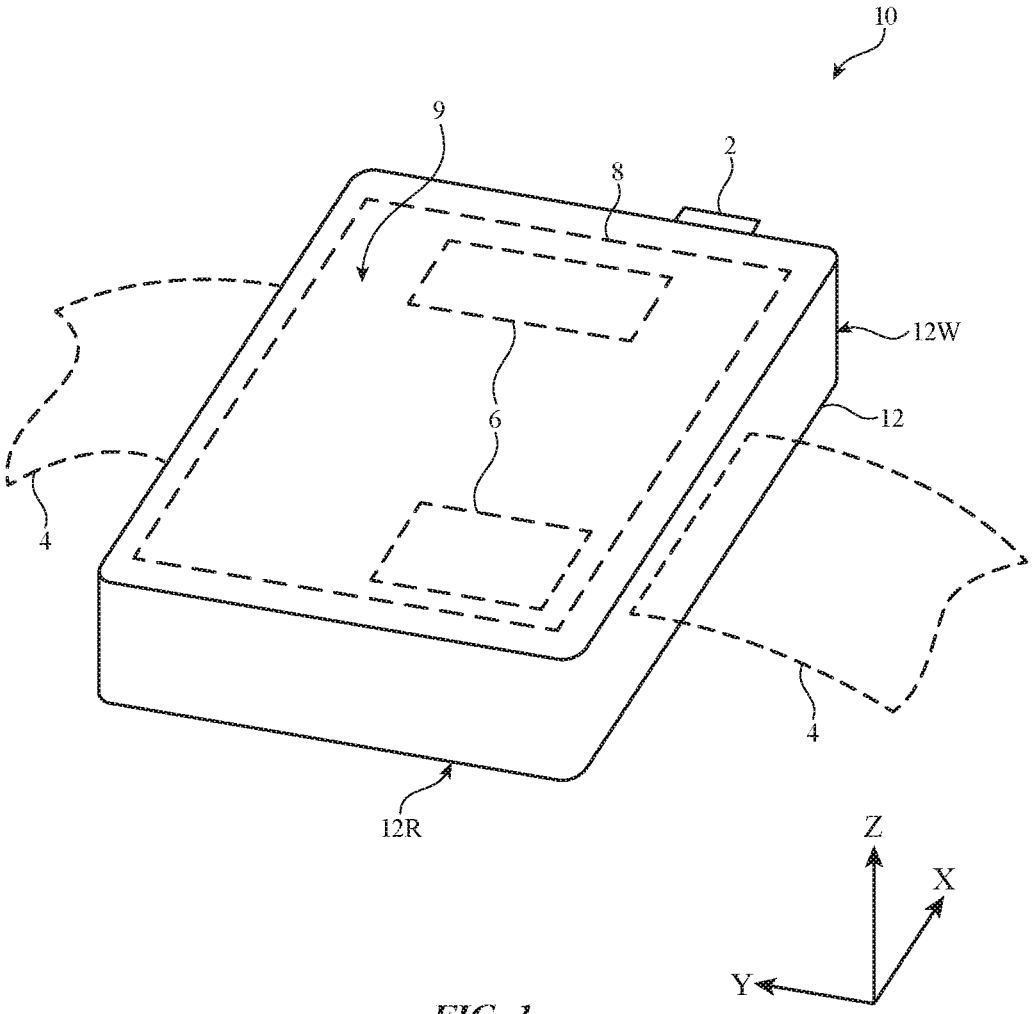
FIG. 1 is a perspective view of an illustrative electronic device with wireless circuitry in accordance with an embodiment.

An electronic device such as electronic device 10 of FIG. 1 may be provided with wireless circuitry. The wireless circuitry may be used to support wireless communications in one or more wireless communications bands. The wireless circuitry may include antennas. Antennas may be formed from or within electrical components or portions of electrical components such as displays, touch sensors, near-field communications antennas, wireless power coils, peripheral antenna resonating elements, conductive traces, and device housing structures, as examples.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a wristwatch (e.g., a smart watch). Other configurations may be used for device 10 if desired. The example of FIG. 1 is merely illustrative.

In the example of FIG. 1, device 10 includes a display such as display 9. Display 9 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). Housing 12 may have metal sidewalls such as sidewalls 12W or sidewalls formed from other materials. Examples of metal materials that may be used for forming sidewalls 12W include stainless steel, aluminum, silver, gold, metal alloys, or any other desired conductive material. Sidewalls 12W may sometimes be referred to herein as housing sidewalls 12W or conductive housing sidewalls 12W.

Display 9 may be formed at (e.g., mounted on) the front side (face) of device 10. Housing 12 may have a rear housing wall on the rear side (face) of device 10 such as rear housing wall 12R that opposes the front face of device 10. Conductive housing sidewalls 12W may surround the periphery of device 10 (e.g., conductive housing sidewalls 12W may extend around peripheral edges of device 10). Rear housing wall 12R may be formed from conductive materials and/or dielectric materials. Examples of dielectric materials that may be used for forming rear housing wall 12R include plastic, glass, sapphire, ceramic, wood, polymer, combinations of these materials, or any other desired dielectrics.

Rear housing wall 12R and/or display 9 may extend across some or all of the length (e.g., parallel to the X-axis of FIG. 1) and width (e.g., parallel to the Y-axis) of device 10. Conductive housing sidewalls 12W may extend across some or all of the height of device 10 (e.g., parallel to Z-axis). Conductive housing sidewalls 12W and/or rear housing wall 12R may form one or more exterior surfaces of device 10 (e.g., surfaces that are visible to a user of device 10) and/or may be implemented using internal structures that do not form exterior surfaces of device 10 (e.g., conductive or dielectric housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide housing walls 12R and/or 12W from view of the user).

Display 9 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 9 may include an array of display pixels formed from liquid crystal display (LCD) components, an array of electrophoretic display pixels, an array of plasma display pixels, an array of organic light-emitting diode (OLED) display pixels, an array of electrowetting display pixels, or display pixels based on other display technologies.

Display 9 may be protected using a display cover layer. The display cover layer may be formed from a transparent material such as glass, plastic, sapphire or other crystalline dielectric materials, ceramic, or other clear materials. The display cover layer may extend across substantially all of the length and width of device 10, for example.

Device 10 may include buttons such as button 2. There may be any suitable number of buttons in device 10 (e.g., a single button, more than one button, two or more buttons, five or more buttons, etc. Buttons may be located in openings in housing 12 (e.g., openings in conductive housing sidewall 12W or rear housing wall 12R) or in an opening in display 9 (as examples). Buttons may be rotary buttons, sliding buttons, buttons that are actuated by pressing on a movable button member, etc. Button members for buttons such as button 2 may be formed from metal, glass, plastic, or other materials. Button 2 may sometimes be referred to as a crown in scenarios where device 10 is a wristwatch device.

Device 10 may, if desired, be coupled to a strap such as strap 4. Strap 4 may be used to hold device 10 against a user's wrist (as an example). Strap 4 may sometimes be referred to herein as wrist strap 4. In the example of FIG. 1, wrist strap 4 is connected to opposing sides of device 10. Conductive housing sidewalls 12W may include attachment structures for securing wrist strap 4 to housing 12 (e.g., lugs or other attachment mechanisms that configure housing 12 to receive wrist strap 4). Configurations that do not include straps may also be used for device 10.

One or more antennas may be mounted within device 10 at one or more locations such as locations 6 shown in FIG. 1. Locations 6 may include, for example, locations at the corners of housing 12, locations at or near the center of display 9, locations along the peripheral edges of housing 12, locations between the peripheral edges of housing 12 and the center of display 9, at rear housing wall 12R, under the display cover glass or other dielectric display cover layer that is used in covering and protecting display 9 on the front of device 10, under a dielectric window on rear housing wall 12R, or elsewhere in device 10. Locations 6 may include portions of display 9 that do not include touch sensor electrodes for gathering touch input from a user or may include portions of display 9 that do include touch sensor electrodes. In another suitable arrangement, location 8 may be used to mount an antenna within device 10. Location 8 may extend across most of display 9 (e.g., the antenna may extend across substantially all of the lateral area of display 9). The antennas within device 10 may be integrated within display 9 (e.g., at locations such as locations 6 or 8) to optimize space consumption within device 10 and to maximize antenna efficiency given the small form factor of device 10 (particularly in scenarios where housing 12 is made from metal). Multiple antennas may be integrated within display 9 if desired (e.g., one antenna may be mounted at each location 6).

Figure 2:
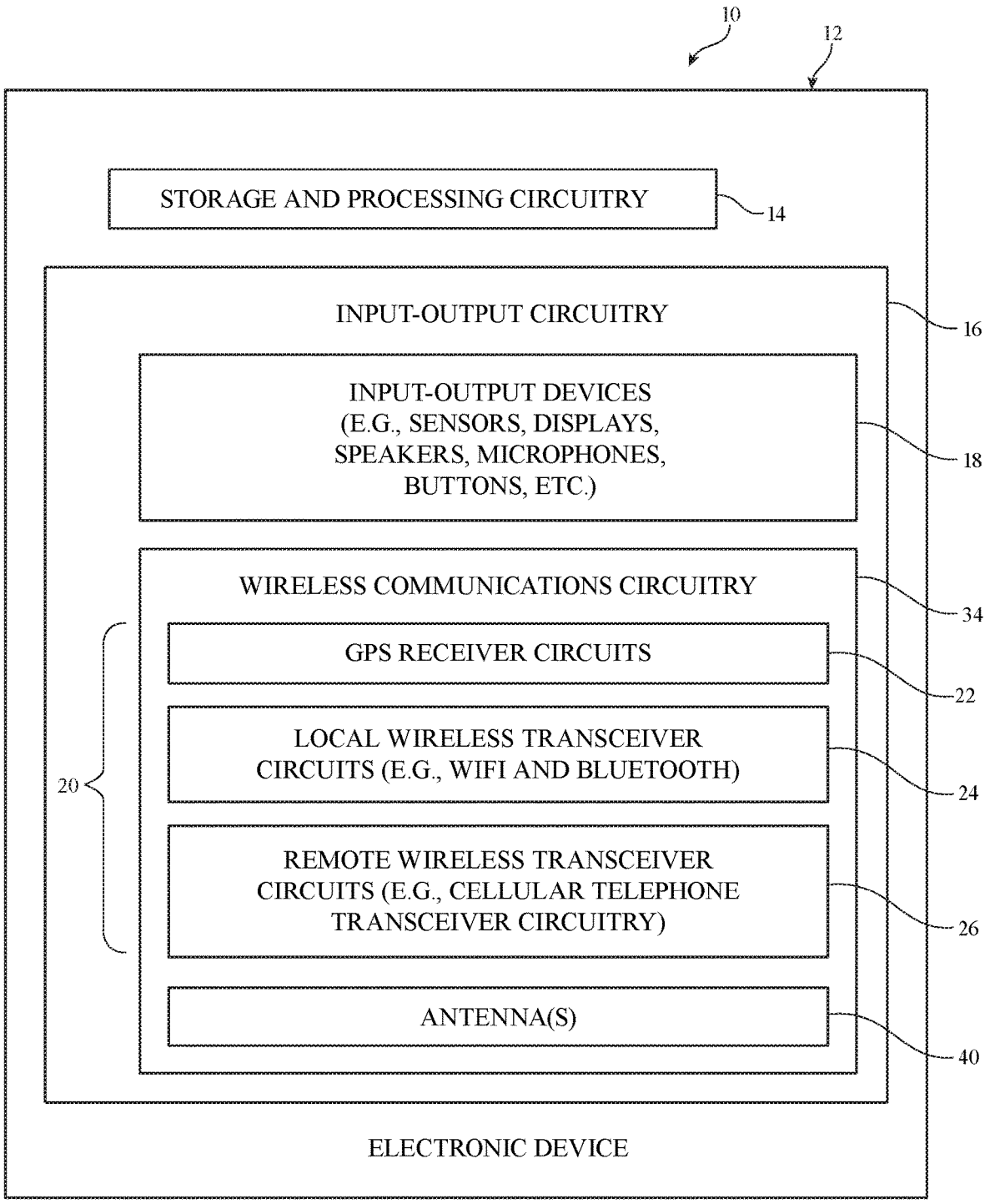
FIG. 2 is a schematic diagram of an illustrative electronic device with wireless circuitry in accordance with an embodiment.

FIG. 2 is a schematic diagram showing illustrative components that may be used in device 10. As shown in FIG. 2, device 10 may include control circuitry such as storage and processing circuitry 14. Storage and processing circuitry 14 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 14 may be used to control the operation of device 10. This processing circuitry may be based on one or more microprocessors, microcontrollers, digital signal processors, application specific integrated circuits, etc.

Storage and processing circuitry 14 may be used to run software on device 10, such as internet browsing applications, voice-over-internet-protocol (VOIP) telephone call applications, email applications, media playback applications, operating system functions, etc. To support interactions with external equipment, storage and processing circuitry 14 may be used in implementing communications protocols. Communications protocols that may be implemented using storage and processing circuitry 14 include internet protocols, wireless local area network protocols (e.g., IEEE 802.11 protocols—sometimes referred to as Wi-Fi®), protocols for other short-range wireless communications links such as the Bluetooth® protocol, cellular telephone protocols, multiple-input and multiple-output (MIMO) protocols, antenna diversity protocols, etc.

Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices 18 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, fingerprint sensors (e.g., a fingerprint sensor integrated with a button), etc.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 20 for handling various radio-frequency communications bands. For example, circuitry 34 may include transceiver circuitry 22, 24, and/or 26. Transceiver circuitry 24 may handle 2.4 GHz and 5 GHz bands for Wi-Fi® (IEEE 802.11) communications and may handle the 2.4 GHz Bluetooth® communications band. Circuitry 34 may use cellular telephone transceiver circuitry 26 for handling wireless communications in frequency ranges such as a low communications band from 600 to 960 MHz, a low-midband from 1400-1520 MHz, a midband from 1710 to 2170 MHz, and a high band from 2300 to 2700 MHz or other communications bands between 600 MHz and 4000 MHz or other suitable frequencies (as examples). Circuitry 26 may handle voice data and non-voice data. Wireless communications circuitry 34 can include circuitry for other short-range and long-range wireless links if desired. For example, wireless communications circuitry 34 may include millimeter wave (e.g., 60 GHz) transceiver circuitry, circuitry for receiving television and radio signals, paging system transceivers, near field communications (NFC) circuitry, etc. Wireless communications circuitry 34 may include wireless power receiving circuitry and a wireless power receiving coil for wirelessly charging a battery on device 10 if desired.

Wireless communications circuitry 34 may include global positioning system (GPS) receiver equipment such as GPS receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth. In Wi-Fi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas 40. Antennas 40 may be formed using any suitable antenna types. For example, antennas 40 may include antennas with resonating elements that are formed from patch antenna structures, loop antenna structures, dipole antenna structures, monopole antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna. If desired, two or more antennas 40 may be arranged in a phased antenna array that are operated using beam steering techniques (e.g., schemes in which antenna signal phase and/or magnitude for each antenna in an array is adjusted to perform beam steering). Antenna diversity schemes may also be used to ensure that antennas that have become blocked or that are otherwise degraded due to the operating environment of device 10 can be switched out of use and higher-performing antennas used in their place.

Figure 3:
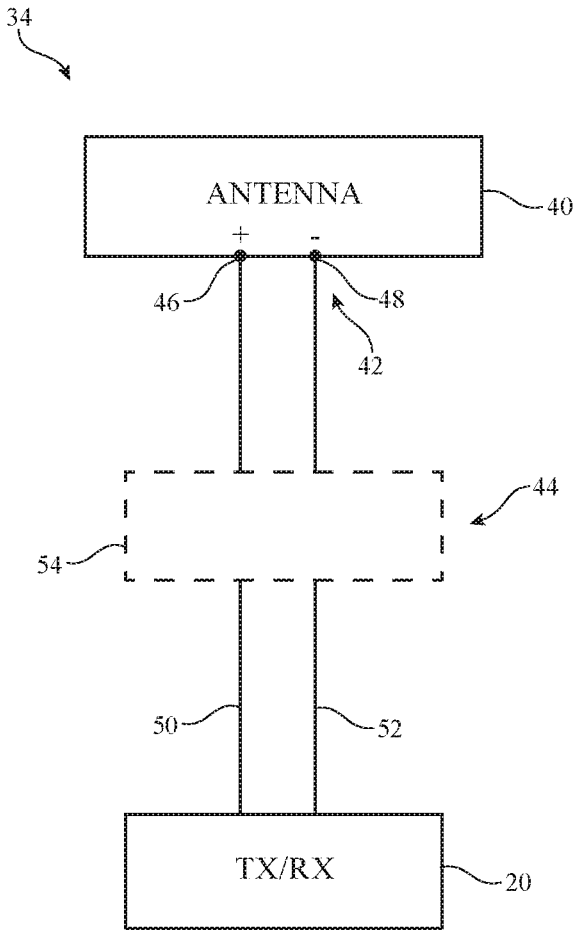
FIG. 3 is a diagram of an illustrative transceiver circuit and antenna in accordance with an embodiment.

As shown in FIG. 3, transceiver circuitry 20 in wireless communications circuitry 34 may be coupled to antenna feed 42 on antenna 40 using radio-frequency transmission line 44. Antenna feed 42 may include a positive antenna feed terminal such as positive antenna feed terminal 46 and may include a ground antenna feed terminal such as ground antenna feed terminal 48. Transmission line 44 may be formed from metal traces on a printed circuit or other conductive structures and may have a positive transmission line signal path such as path 50 (sometimes referred to herein as signal conductor 50) that is coupled to terminal 46 and a ground transmission line signal path such as path 52 (sometimes referred to herein as ground conductor 52) that is coupled to terminal 48. Other types of antenna feed arrangements may be used if desired. For example, antenna structures 40 may be fed using multiple feeds. The illustrative feeding configuration of FIG. 3 is merely illustrative.

Transmission line paths such as transmission line 44 may be used to route antenna signals within device 10. Transmission line 44 may include coaxial cable paths, microstrip transmission lines, stripline transmission lines, edge-coupled microstrip transmission lines, edge-coupled stripline transmission lines, transmission lines formed from combinations of transmission lines of these types, or any other desired radio-frequency transmission line structures. Filter circuitry, switching circuitry, impedance matching circuitry, and other circuitry may be coupled to antenna 40 (e.g., to support antenna tuning, to support operation in desired frequency bands, etc.).

Transmission line paths in device 10 such as transmission line 44 may be integrated into rigid and/or flexible printed circuit boards if desired. In one suitable arrangement, transmission line paths in device 10 may include transmission line conductors (e.g., signal and/or ground conductors) that are integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive). Filter circuitry, switching circuitry, impedance matching circuitry, and other circuitry may be interposed within the transmission lines, if desired.

If desired, optional impedance matching circuitry 54 may be interposed on transmission line 44. Impedance matching circuitry 54 may include fixed and/or tunable components. For example, circuitry 54 may include a tunable impedance matching network formed from components such as inductors, resistors, and capacitors that are used in matching the impedance of antenna structures 40 to the impedance of transmission line 44. If desired, circuitry 54 may include a band pass filter, band stop filter, high pass filter, and/or low pass filter. Components in matching circuitry 54 may be provided as discrete components (e.g., surface mount technology components) or may be formed from housing structures, printed circuit board structures, traces on plastic supports, etc. In scenarios where matching circuitry 54 is adjustable, storage and processing circuitry 14 (FIG. 2) may provide control signals that adjust the impedance provided by matching circuitry 54, for example. Matching circuitry 54 and/or other tunable components coupled to antenna 40 may be adjusted (e.g., using control signals provided by control circuitry 14) to cover different desired communications bands.

Figure 4:
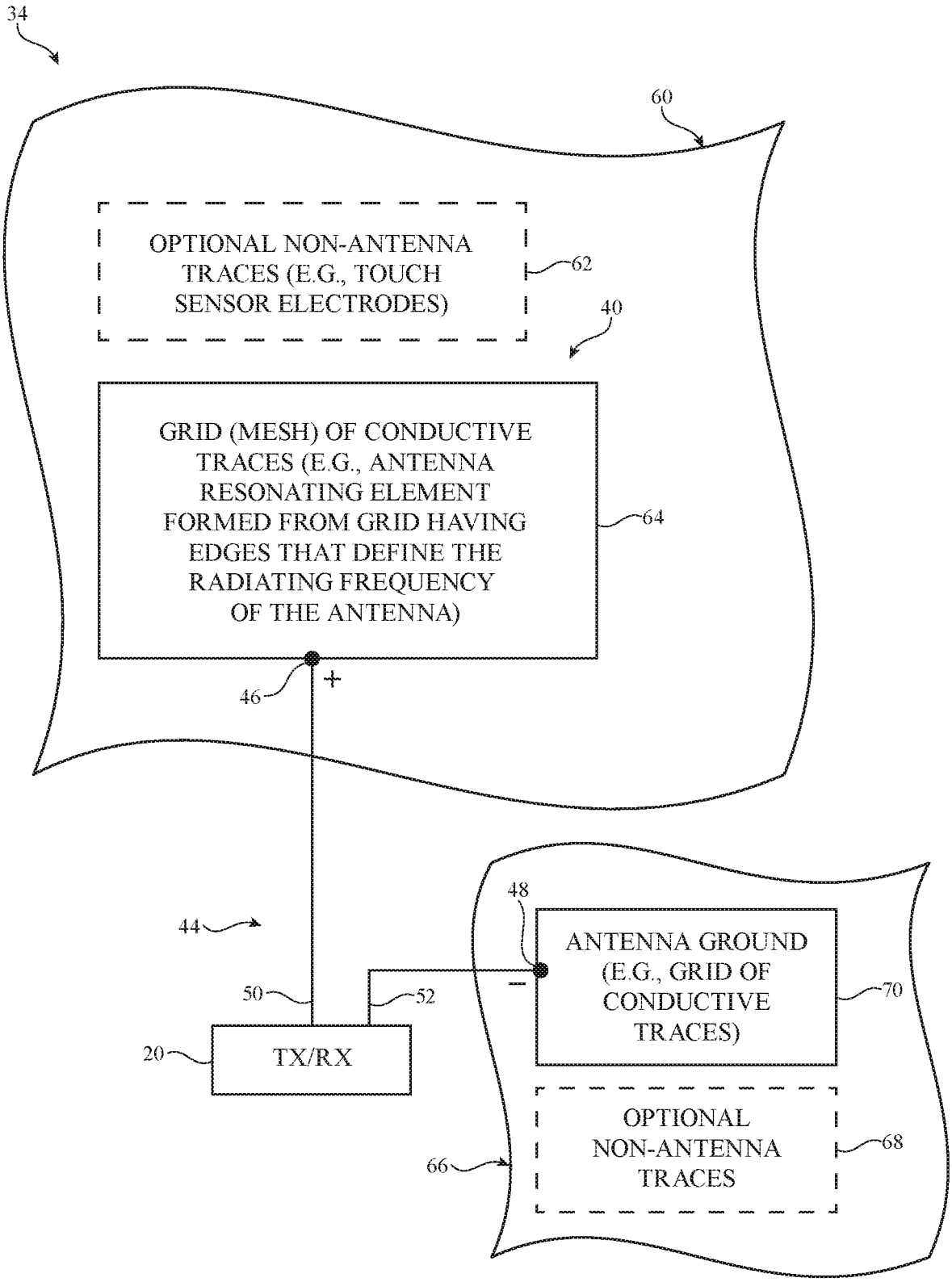
FIG. 4 is a diagram of an antenna formed from a grid of conductive traces in a conductive layer in accordance with an embodiment.

If desired, one or more antennas 40 may be integrated within display 9 of FIG. 1. Antennas that are integrated within display 9 may include antenna structures formed from patterns of conductive traces in one or more conductive layers on a dielectric substrate. FIG. 4 is a diagram showing how antenna 40 (e.g., an antenna integrated within display 9 of FIG. 1) may be formed using patterns of conductive traces in one or more conductive layers on a dielectric substrate.

As shown in FIG. 4, wireless communications circuitry 34 may include conductive layers such as conductive layers 60 and 66. Conductive layers 60 and 66 may be formed on a dielectric substrate (e.g., different surfaces of the same dielectric substrate). The dielectric substrate may include multiple stacked dielectric layers. The dielectric substrate may include a display module for display 9 (FIG. 1) having stacked dielectric display layers, for example.

In one suitable arrangement, conductive layers 60 and 66 are formed on opposing sides of a given dielectric layer in the substrate. In another suitable arrangement, conductive layers 60 and 66 are formed on different dielectric layers in the substrate. Conductive layers 60 and 66 may be formed from metal traces, metal foil, stamped sheet metal, conductive coatings on the dielectric substrate, conductive portions of housing 12 (FIG. 1), or any other desired conductive structures. Conductive layers 60 and 66 may include, for example, indium tin oxide (ITO), copper, aluminum, stainless steel, silver, gold, nickel, tin, other metals or metal alloys, or any other desired conductive materials.

Conductive layer 60 may include a region (portion) 64 that is patterned to form a grid or mesh of intersecting conductive traces. Region 64 may sometimes be referred to herein as grid 64 of conductive traces in conductive layer 60, mesh 64 of conductive traces in conductive layer 60, or pattern 64 of conductive traces in conductive layer 60. Grid 64 may include segments of conductive traces arranged in a grid or mesh pattern (e.g., segments of conductive traces arranged in array of crossing (intersecting) rows and columns and each surrounding openings in conductive layer 60). Grid 64 may be separated from conductive material within other regions (portions) of conductive layer 60 by gaps or openings in conductive layer 60.

Antenna 40 may include antenna structures such as an antenna resonating element, an antenna ground, and antenna feed 42 (FIG. 3). The antenna resonating element may be coupled to positive antenna feed terminal 46 whereas the antenna ground is coupled to ground antenna feed terminal 48. The antenna resonating element may have dimensions (e.g., a particular shape, perimeter, and/or area) that support an antenna resonance within one or more desired frequency bands (e.g., for performing wireless communications in those frequency bands).

As shown in FIG. 4, positive antenna feed terminal 46 may be coupled to grid 64 in conductive layer 60 so that grid 64 forms the antenna resonating element for antenna 40. Conductive layer 66 may include a region 70 that forms an antenna ground for antenna 40. Region 70 may sometimes be referred to herein as antenna ground 70 or ground plane 70. Antenna ground 70 may be separated from conductive material in other regions of conductive layer 66 by openings or gaps in conductive layer 66. Ground antenna feed terminal 48 of antenna 40 may be coupled to antenna ground 70 in conductive layer 66.

Grid 64 of conductive layer 60 may receive radio-frequency signals from transceiver circuitry 20 over positive antenna feed terminal 46. Corresponding antenna currents may flow through the segments of conductive traces in grid 64. Openings or gaps in conductive layer 60 may prevent the antenna currents from flowing to other portions of conductive layer 60 that are not a part of grid 64. Antenna currents flowing through grid 64 and antenna ground 70 may generate wireless signals that are radiated by antenna 40. Similarly, antenna 40 may receive wireless signals from external communications equipment. The received wireless signals may generate antenna currents on grid 64 and antenna ground 70 that are then conveyed to transceiver 20 over transmission line 44.

The conductive material used to form conductive layers 60 and 66 may be substantially transparent. For example, in one suitable arrangement, conductive layers 60 and 66 include ITO traces that are substantially transparent at optical wavelengths. Openings in grid 64 may further increase the optical transparency of grid 64. If desired, antenna ground 70 may be patterned using a grid of conductive traces similar to grid 64 of conductive layer 60. This may, for example, further increase the optical transparency of antenna ground 70. When configured in this way, conductive layers 60 and 66 and antenna 40 may be integrated into display 9 of device 10 (FIG. 1) without being perceptible or easily discernable to a user while viewing display 9, for example.

If desired, conductive layer 60 may include other regions (portions) 62 of conductive traces that are not used to form part of antenna 40. Regions 62 may be separated from grid 64 by gaps or openings in conductive layer 60 to prevent antenna currents on grid 64 from shorting to regions 62. Conductive traces in regions 62 may, for example, form display structures within display 9 of device 10 (FIG. 1). Such display structures may include display pixel circuitry that emit display light, touch sensor electrodes that gather touch input from a user, or other components, as examples.

If desired, conductive layer 66 may include other regions (portions) 68 of conductive traces that are not used to form part of antenna 40. Regions 68 may be separated from antenna ground 70 by gaps or openings in conductive layer 66 to prevent antenna currents on antenna ground 70 from shorting to regions 68. Conductive traces in regions 68 may, for example, form display structures within display 9 of device 10 (FIG. 1). Such display structures may include display pixel circuitry that emit display light, touch sensor electrodes that gather touch input from a user, or other components, as examples. In another suitable arrangement, antenna ground 70 extends across all of conductive layer 66.

If desired, some or all of the conductive traces in grid 64 may be used to form display structures such as pixel circuitry and/or touch sensor electrodes for display 9 (FIG. 1). Some or all of the conductive traces in antenna ground 70 may be used to form display structures such as pixel circuitry and/or touch sensor electrodes, if desired. The example of FIG. 4 is merely illustrative. If desired, multiple grids 64 may be formed within conductive layer 60 and/or multiple antenna grounds 70 may be formed within conductive layer 66 (e.g., to integrate multiple antennas 40 within display 9 of FIG. 1).

Figure 5:
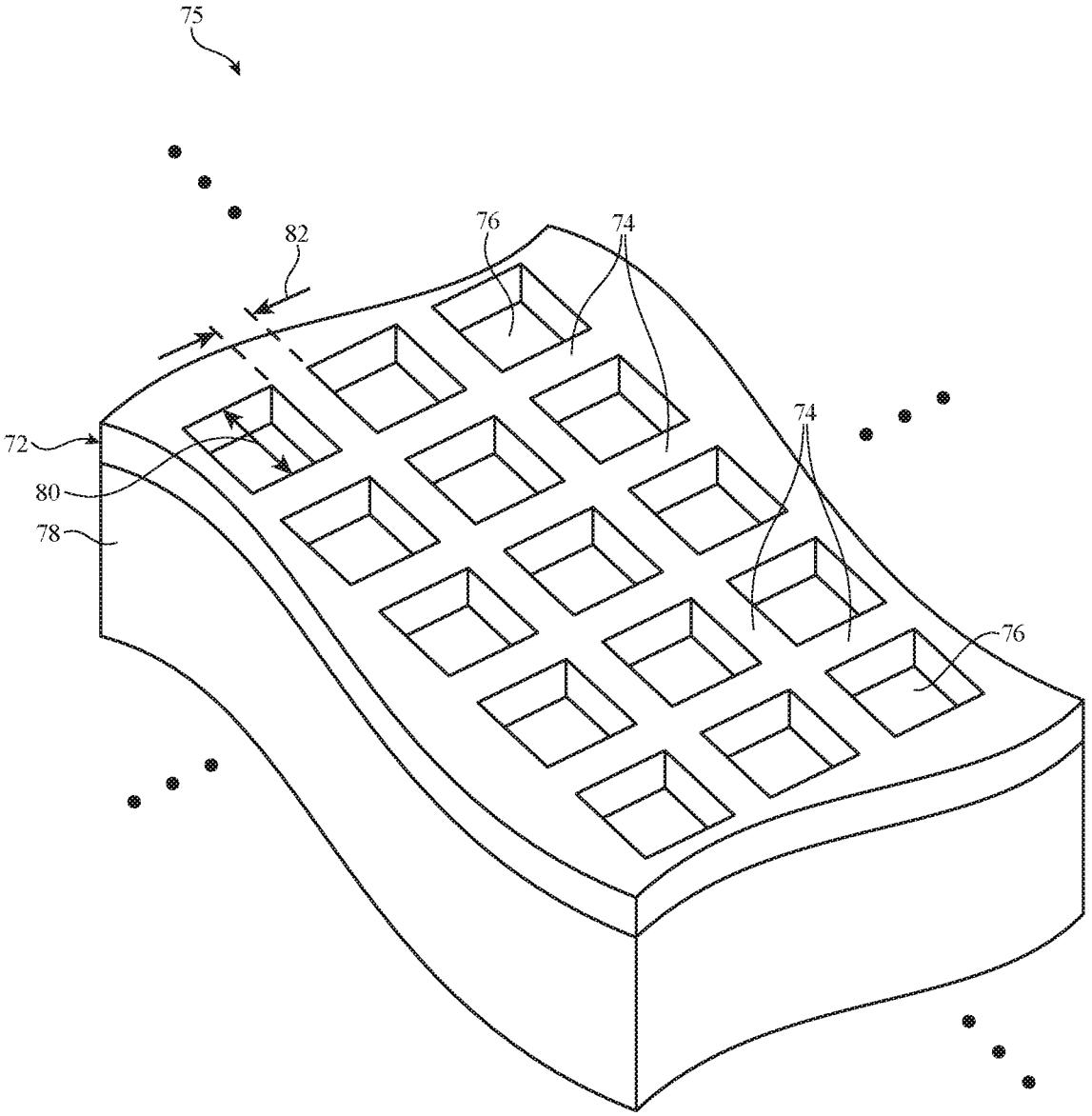
FIG. 5 is a perspective view of a grid of conductive traces in a conductive layer that can be used to form antenna structures in accordance with an embodiment.

FIG. 5 is a perspective view showing a region 75 of conductive traces that may be used in forming grid 64 and/or antenna ground 70 of FIG. 4. As shown in FIG. 5, conductive layer 72 (e.g., a conductive layer such as conductive layers 60 or 66 of FIG. 4) may be formed on a top surface of a dielectric substrate such as dielectric layer 78. Dielectric layer 78 may be formed from plastic, polymer, glass, ceramic, epoxy, foam, a rigid or flexible printed circuit board substrate, or any other desired materials. Conductive layer 72 may include a conductive coating or metal coating, sheet metal, conductive or metal traces, or any other desired conductive structures formed on the top surface of dielectric layer 78. In one suitable arrangement, conductive layer 72 is an ITO layer and the conductive material in conductive layer 72 is formed from ITO.

As shown in FIG. 5, conductive layer 72 may include a pattern of slots 76 (sometimes referred to as notches, gaps, openings, or holes 76) within region 75. Each slot 76 may be completely surrounded by conductive material from conductive layer 72. The conductive material surrounding slots 76 may form segments 74 of conductive traces in conductive layer 72 (sometimes referred to herein as conductive paths 74 or conductive traces 74).

Slots 76 may, for example, be arranged in an array. Conductive segments 74 may be arranged in a grid (mesh) pattern defining the edges of slots 76. Each conductive segment 74 may have a first end coupled to three other segments 74 and a second end coupled to three other segments 74 (e.g., segments 74 may intersect other segments in region 75). Grid 64 of conductive layer 60 and/or antenna ground 70 of conductive layer 66 (FIG. 4) may include slots 76 and corresponding segments 74 of conductive traces as shown in FIG. 5 (e.g., region 75 may be used to implement grid 64 and/or antenna ground 70 of FIG. 4).

Slots 76 may, for example, extend completely through the thickness of conductive layer 72. Slots 76 may be filled with dielectric material, with an integral portion of the underlying dielectric layer 78, or may be void of material. The dimensions of slots 76 and segments 74 may be selected to adjust the inductance of segments 74 and to tweak the radiating characteristics of antenna 40 (FIG. 4).

Region 75 of conductive layer 72 may be described at least in part by two characteristics: the length 80 of each segment 74 of conductive traces (e.g., the width of slots 76 separating two parallel segments 74) and the width 82 of each segment 74 of conductive traces. In practice, shorter widths 82 and greater lengths 80 may increase the optical transparency of conductive layer 72 whereas greater widths 82 and shorter lengths 80 may increase the antenna efficiency for antenna 40 (FIG. 4). In order to balance these effects, length 80 may be between 0.5 mm and 1.0 mm, between 0.2 mm and 1.2 mm, or between 0.1 mm and 5.0 mm, as examples. Width 82 may be between 0.01 mm and 0.20 mm, between 0.05 mm and 0.15 mm, between 0.05 mm and 0.10 mm, or any other desired width less than length 80 and greater than about 0.01 mm, as examples.

In the example of FIG. 5, slots 76 each have the same square shape and size. This is merely illustrative. Slots 76 may have any desired shape having straight and/or curved edges. For example, slots 76 may be triangular, rectangular, hexagonal, polygonal, circular, elliptical, etc. Similarly, segments 74 need not be arranged in a rectangular grid pattern (e.g., segments 74 may be arranged in a hexagonal grid or a triangular grid). In these scenarios, length 80 may be the length of the longest lateral dimension of slots 76 or the length of one of the sides of slots 76. Slots 76 in region 75 need not all be the same size and shape and, if desired, region 75 may include slots 76 of multiple different sizes and/or shapes.

Region 75 of FIG. 5 may be used to form grid 64 of conductive layer 60 (e.g., region 75 of FIG. 5 may be used to form the antenna resonating element for antenna 40). Antenna 40 may include any desired type of antenna having any desired type of antenna resonating element. Region 75 of FIG. 5 may, for example, be used to form a patch antenna resonating element, a dipole antenna resonating element, a monopole antenna resonating element, a loop antenna resonating element, an inverted-F antenna resonating element, a planar inverted-F antenna resonating element, or any other desired antenna resonating elements for antenna 40.

Figure 6:
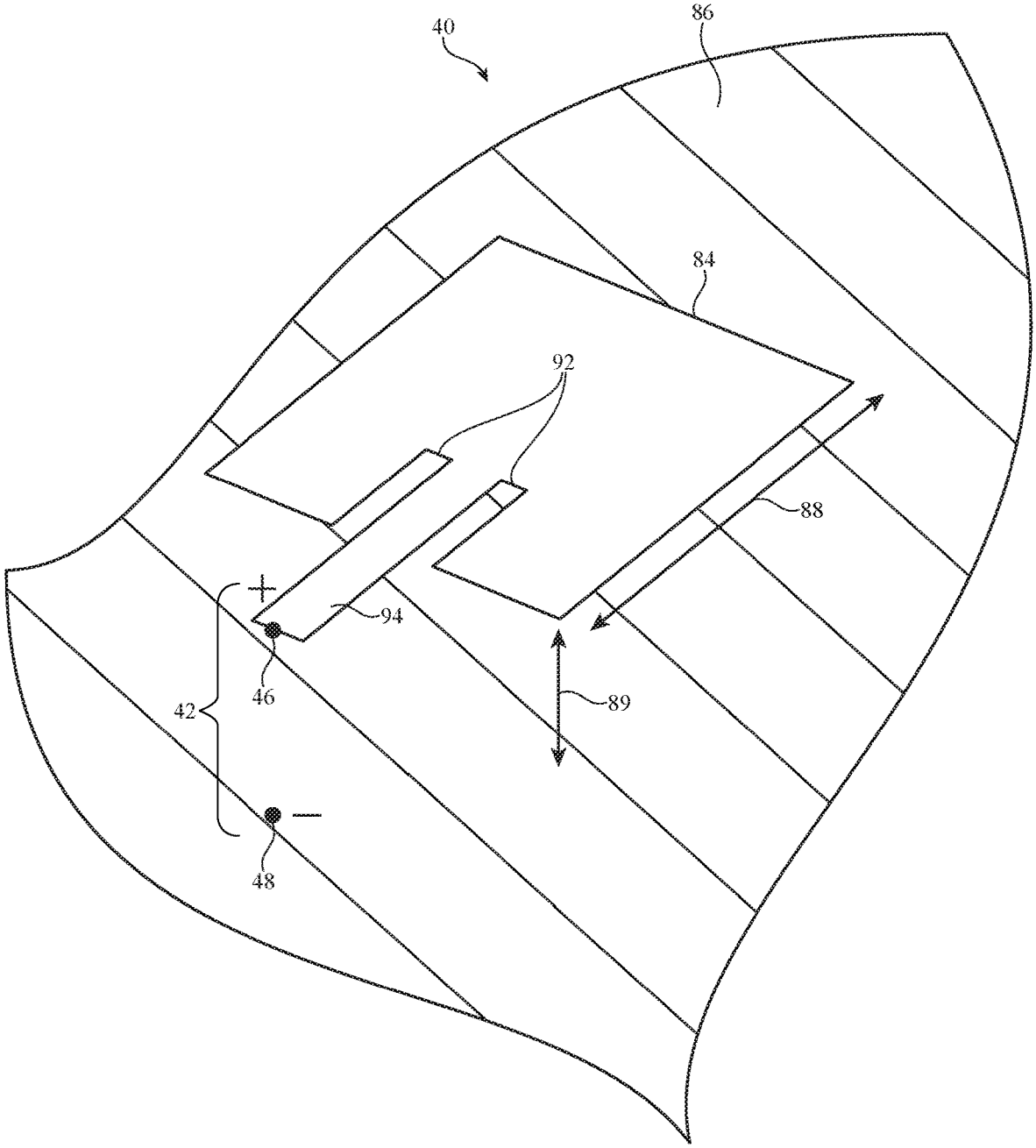
FIG. 6 is a perspective view of an illustrative patch antenna that may be used in an electronic device in accordance with an embodiment.

FIG. 6 is a schematic diagram showing how antenna 40 may be implemented as a patch antenna. As shown in FIG. 6, antenna 40 may include a patch antenna resonating element 84 that is separated from and parallel to a ground plane such as ground plane 86. Arm 94 may be coupled between patch antenna resonating element 84 and positive antenna feed terminal 46 of antenna feed 42. Ground antenna feed terminal 48 may be coupled to ground plane 86. Patch antenna resonating element 84 may be separated from ground plane 86 by distance 89. Patch antenna resonating element 84 may sometimes be referred to herein as patch element 84, patch radiating element 84, or patch 84.

If desired, impedance matching notches 92 may be formed in patch element 84 to help match the impedance of patch element 84 to the impedance of transmission line 44 (FIG. 3). The length 88 of the sides of patch element 84 may be selected so that antenna 40 resonates at a desired operating frequency. For example, length 88 may be approximately equal to one-half of the wavelength corresponding to the operating frequency for antenna 40 (e.g., an effective wavelength that accounts for dielectric loading by dielectric material between patch element 84 and ground plane 86).

The example of FIG. 6 is merely illustrative. If desired, patch element 84 may have different shapes and orientations (e.g., planar shapes, curved patch shapes, patch element shapes with non-rectangular outlines, shapes with straight edges such as squares, shapes with curved edges such as ovals and circles, shapes with combinations of curved and straight edges, etc.). Antenna 40 may be provided with multiple antenna feeds for covering multiple polarizations if desired.

Figure 7:
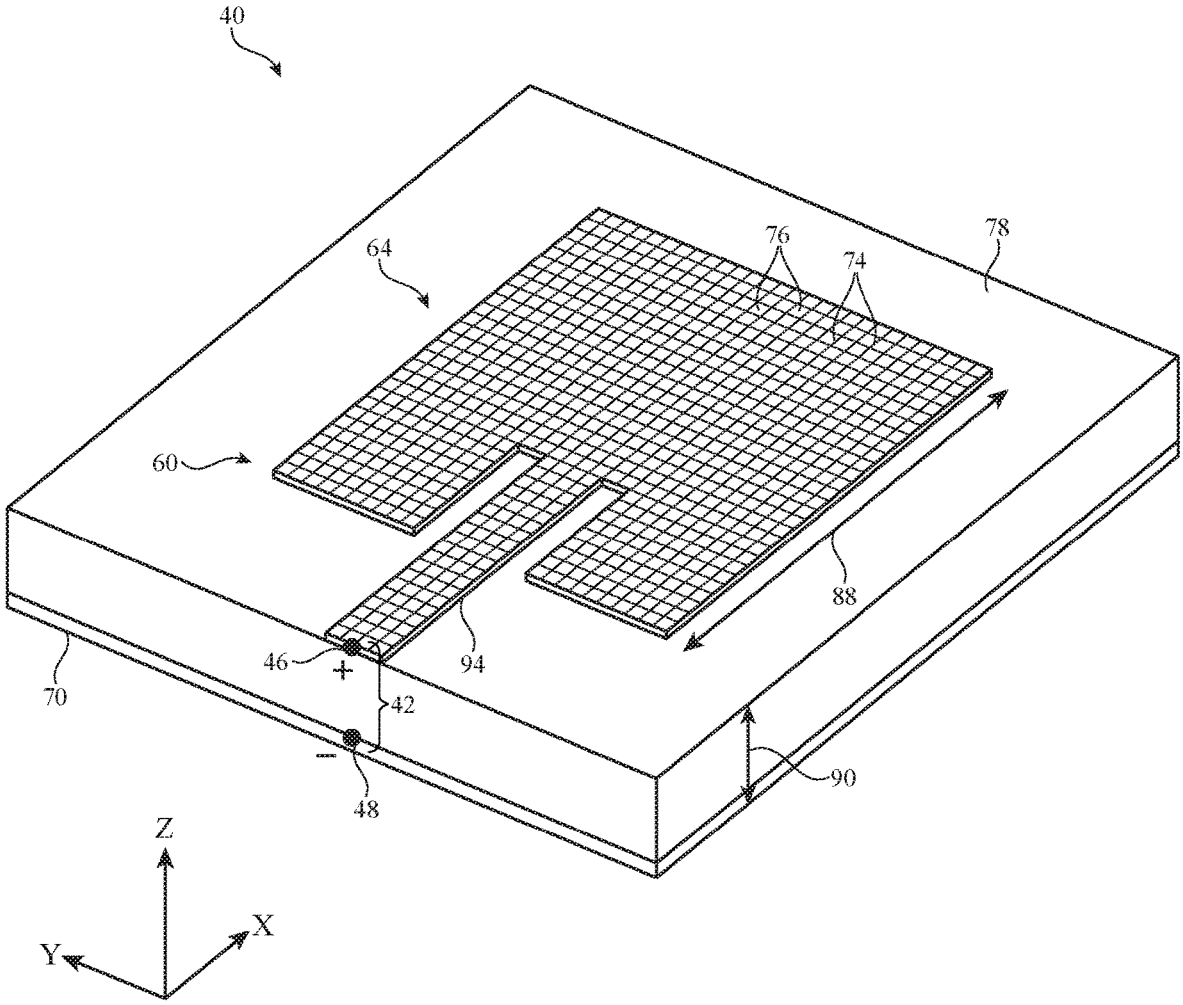
FIG. 7 is a perspective view of an illustrative patch antenna formed from a grid of conductive traces in a conductive layer in accordance with an embodiment.

FIG. 7 is a perspective view showing how a patch antenna of the type shown in FIG. 6 may be formed using conductive layers 60 and 70 of FIG. 4. As shown in FIG. 7, antenna 40 may include grid 64 of conductive traces in conductive layer 60. Conductive layer 60 may be formed on a top surface of dielectric layer 78. Grid 64 may include segments 74 of conductive traces arranged in a grid pattern and surrounding slots 76.

Grid 64 may form the antenna resonating element (e.g., patch element 84 of FIG. 6) for antenna 40. Grid 64 may have edges that define the outline of the antenna resonating element. Grid 64 may have sides of length 88 to define the resonating frequencies for antenna 40. Positive antenna feed terminal 46 may be coupled to a segment 74 of conductive traces in arm 94 of the antenna resonating element.

Antenna ground 70 may be formed from conductive traces at the bottom surface of dielectric layer 78. Antenna ground 70 may include a grid pattern of segments 74 and slots 76 if desired. Antenna ground 70 may form ground plane 86 (FIG. 6) for antenna 40. Ground antenna feed terminal 48 may be coupled to antenna ground 70.

Other regions of conductive layer 60 (e.g., regions 62 of FIG. 4) may be formed on the top surface of dielectric layer 78. These regions are not shown in FIG. 7 for the sake of clarity. Antenna current conveyed by positive antenna feed terminal 46 may pass through segments 74 of conductive traces in grid 64. The antenna current may flow around the edges of grid 64 to radiate wireless signals. The interior of grid 64 (e.g., the segments 74 and slots 76 within the edges of grid 64) may appear as a solid conductor to the antenna currents, for example. At the same time, grid 64 may be substantially transparent or invisible at optical wavelengths.

Dielectric layer 78 may have a thickness (height) 90. Thickness 90 of dielectric layer 78 may be, for example, between 6 mm and 1 mm, between 5.5 mm and 2 mm, between 5 mm and 3 mm, less than 1 mm, between 0.1 mm and 2 mm, or greater than 6 mm (e.g., 1 cm, 5 cm, 10 cm, etc.). Conductive layer 60 may have a thickness (e.g., parallel to the Z-axis of FIG. 7) of between 100 nm and 10 nm, between 75 nm and 25 nm, less than 25 nm, greater than 100 nm, between 0.1 mm and 0.5 mm, between 500 microns and 1 mm, between 1 and 500 microns, or greater than 1 mm, as examples.

The example of FIG. 7 is merely illustrative. Antenna 40 may be implemented using any desired antenna structures. Multiple dielectric layers may be used to separate antenna ground 70 from conductive layer 60. Antenna 40 may be integrated within display 9 of FIG. 1 without obstructing images displayed by display 9.

Figure 8:
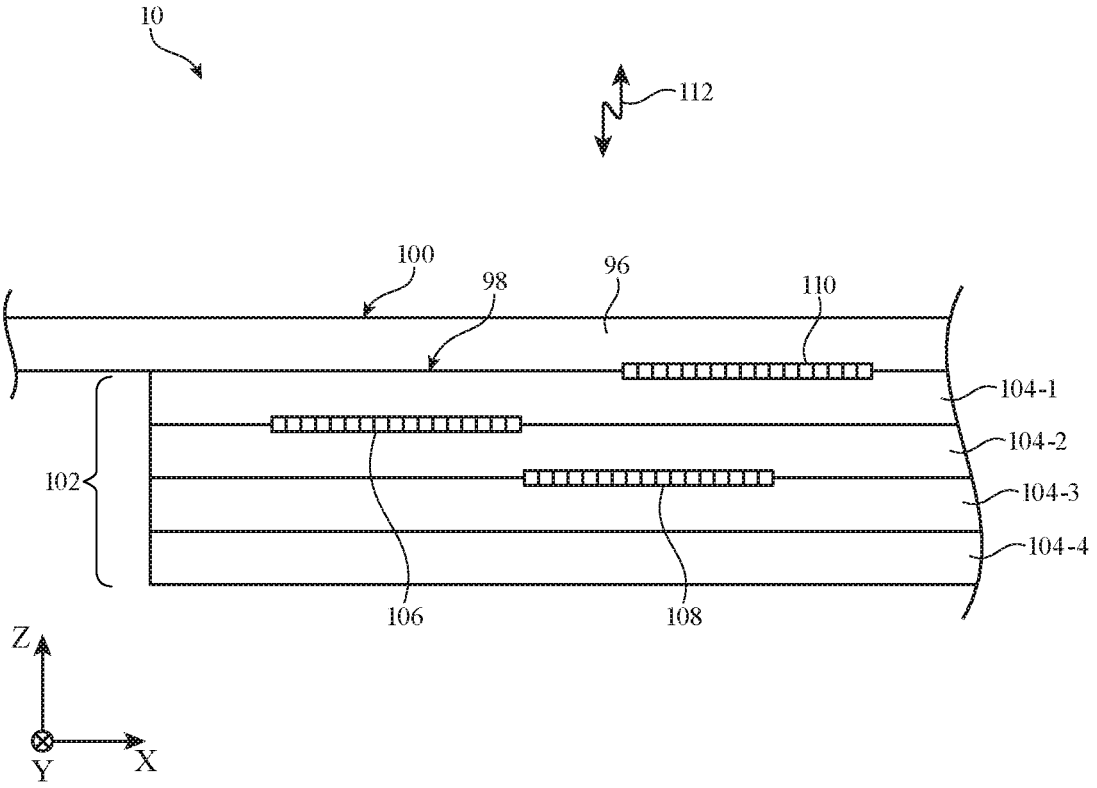
FIG. 8 is a cross-sectional side view of an illustrative display module showing different locations on the display module that may be used for mounting antennas of the type shown in FIG. 7 in accordance with an embodiment.

FIG. 8 is a cross-sectional side view showing how antenna 40 may be integrated within a dielectric substrate such as a display module for display 9 (FIG. 1). The plane of the page of FIG. 8 may, for example, lie in the X-Z plane of FIG. 7.

As shown in FIG. 8, device 10 may include a dielectric substrate such as dielectric substrate 102. Dielectric substrate 102 may be, for example, a rigid or flexible printed circuit board or other dielectric substrate. Substrate 102 may include multiple stacked dielectric layers (e.g., multiple layers of printed circuit board substrate such as multiple layers of fiberglass-filled epoxy) or may include a single dielectric layer. Substrate 102 may include any desired dielectric materials such as epoxy, plastic, ceramic, glass, foam, or other materials.

In the example of FIG. 8, substrate 102 includes multiple stacked dielectric layers 104 (e.g., a first layer 104-1, a second layer 104-2, a third layer 104-3, a fourth layer 104-4, etc.). Substrate 102 may form a part of display 9 of FIG. 1 and may therefore sometimes be referred to herein as display module 102 or display stack 102.

As shown in FIG. 8, substrate 102 may be mounted to an interior surface 98 of dielectric cover layer 96. Dielectric cover layer 96 may form a portion of rear wall 12R or sidewalls 12W of device 10 (FIG. 1), as examples. Dielectric cover layer 96 may have an exterior surface 100 that forms an external surface for device 10. In scenarios where substrate 102 forms a part of display 9 (FIG. 1), dielectric cover layer 96 may be a display cover layer that covers display 9 (e.g., that extends across substantially all of the front face of device 10).

Dielectric cover layer 96 may be a clear layer of plastic, glass, sapphire, or other materials. If desired, an opaque masking layer such as an ink layer may be formed at interior surface 98 of dielectric cover layer 96 (e.g., in scenarios where dielectric cover layer 96 is transparent). Display structures may be formed on dielectric substrate 102. The display structures may produce images for a user (e.g., images that are displayed through dielectric cover layer 96) and may receive touch input from a user (e.g., in response to touch or force applied to exterior surface 100 of dielectric cover layer 96).

Display structures in dielectric substrate 102 may include liquid crystal display structures, electrophoretic display structures, light-emitting diode display structures such as organic light-emitting diode display structures, or other suitable display structures. Dielectric layers 104 in substrate 102 may include layers of backlight structures, layers of light guide structures, layers of light source structures such as layers that include an array of light-emitting diodes or other display pixel circuitry, light reflector structures, optical films, diffuser layers, light collimating layers, polarizer layers, planarization layers, liquid crystal layers, color filter layers, thin-film transistor layers, optically transparent substrate layers, optically opaque substrate layers, layers for forming touch sensor electrodes associated with touch sensing capabilities for display 9 (in scenarios where display 9 is a touch sensor), birefringent compensating films, antireflection coatings, scratch prevention coatings, oleophobic coatings, layers of adhesive, stretched polymer layers such as stretched polyvinyl alcohol layers, tri-acetyl cellulose layers, antiglare layers, plastic layers, and/or any other desired layers used to form display structures for displaying images to a user of device 10 and/or for receiving a touch or force input from a user of device 10.

Some dielectric layers 104 may be used to form pixel circuitry for displaying images while other dielectric layers 104 are used to form touch sensor electrodes for gathering touch sensor input, in one example. The touch sensor electrodes may include an array of capacitive electrodes (e.g., transparent electrodes such as indium tin oxide electrodes) or may include a touch sensor array based on other touch technologies (e.g., resistive touch sensor structures, acoustic touch sensor structures, piezoelectric sensors and other force sensor structures, etc.).

Antenna 40 may be partially or completely embedded within substrate 102. Conductive layer 60 for forming the antenna resonating element of antenna 40 (FIG. 7) may be formed on any desired layers 104 in substrate 102. For example, conductive layer 60 may be formed on an upper lateral surface of layer 104-1 (e.g., layer 104-1 may serve as dielectric layer 78 of FIG. 7). In this scenario, grid 64 (FIGS. 4 and 7) may be formed at location 110 of FIG. 8. Conductive layer 60 may directly contact dielectric cover layer 96 or may be coupled to dielectric cover layer 96 using adhesive. If desired, conductive layer 60 may be patterned directly onto dielectric cover layer 96 before affixing dielectric cover layer 96 to substrate 102.

As another example, conductive layer 60 may be formed on an upper lateral surface of layer 104-2 (e.g., conductive layer 60 may be embedded within the layers of substrate 102 and layer 104-2 may serve as dielectric layer 78 of FIG. 7). In this scenario, grid 64 may be formed at location 106 of FIG. 8. In yet another example, conductive layer 60 may be formed on an upper lateral surface of layer 104-3 (e.g., layer 104-3 may serve as dielectric layer 78 of FIG. 7). In this scenario, grid 64 may be formed at location 108 of FIG. 8. In general, locations that are closer to dielectric cover layer 96 may offer improved isolation and antenna efficiency relative to locations that are farther from dielectric cover layer 96. These examples are merely illustrative and, in general, conductive layer 60 may be formed on any desired layer 104 within substrate 102 and at any desired location across the lateral area of substrate 102 (e.g., at locations such as locations 6 and 8 of FIG. 1). Grid 64 may extend some or all of the underlying layer if desired. Multiple antennas may be formed from multiple conductive layers on multiple dielectric layers 104 if desired. Multiple antennas may be formed from conductive layers on the same dielectric layer 104 if desired. Antenna ground 70 (FIG. 7) may be formed on any desired dielectric layer 104 of substrate 102 below conductive layer 60.

When arranged in this way, antenna 40 may convey radio-frequency signals 112 through dielectric cover layer 96. Grid 64 may be formed within the same conductive layer (e.g., conductive layer 60 of FIGS. 4 and 7) as pixel circuitry and/or touch sensor electrodes in display 9 (FIG. 1). If desired, some or all of grid 64 may also be used to form pixel circuitry and/or touch sensor electrodes in display 9. Grid 64 may be substantially transparent at optical wavelengths. By forming the antenna resonating element for antenna 40 using the same conductive layers as other display components in substrate 102, the same manufacturing process (e.g., an ITO deposition process) may be used to form both antenna 40 and the display structures within substrate 102. This may minimize manufacturing complexity and cost relative to scenarios where antenna 40 is otherwise attached to substrate 102, for example.

Figure 9:
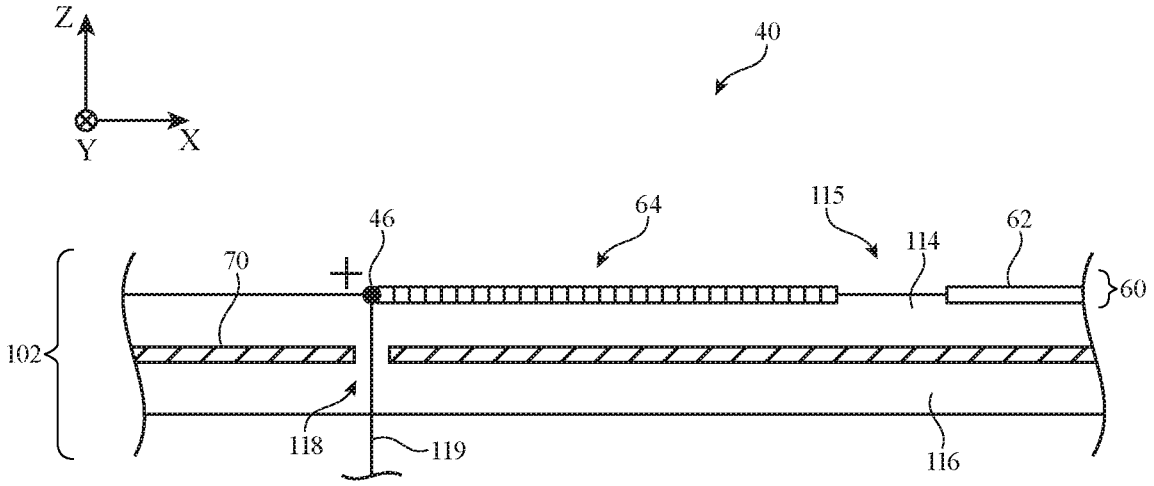
FIG. 9 is a cross-sectional side view showing how an antenna mounted to a display module may be fed using a conductive via in accordance with an embodiment.
Figure 10:
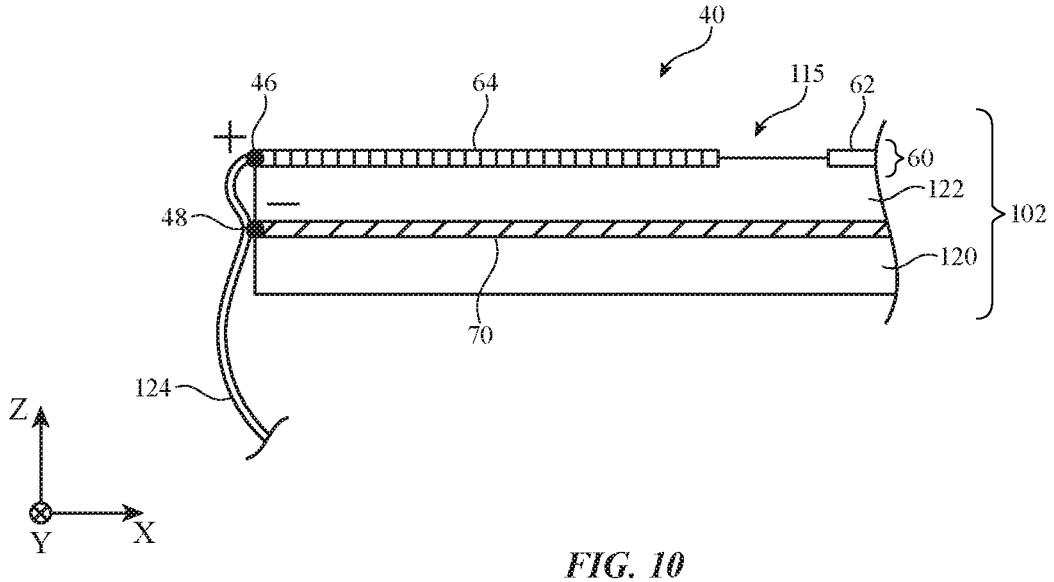
FIG. 10 is a cross-sectional side view showing how an antenna mounted to a display module may be fed using conductive traces on a flexible printed circuit that is also used to convey touch signals for touch sensor electrodes in the display module in accordance with an embodiment.
Figure 11:
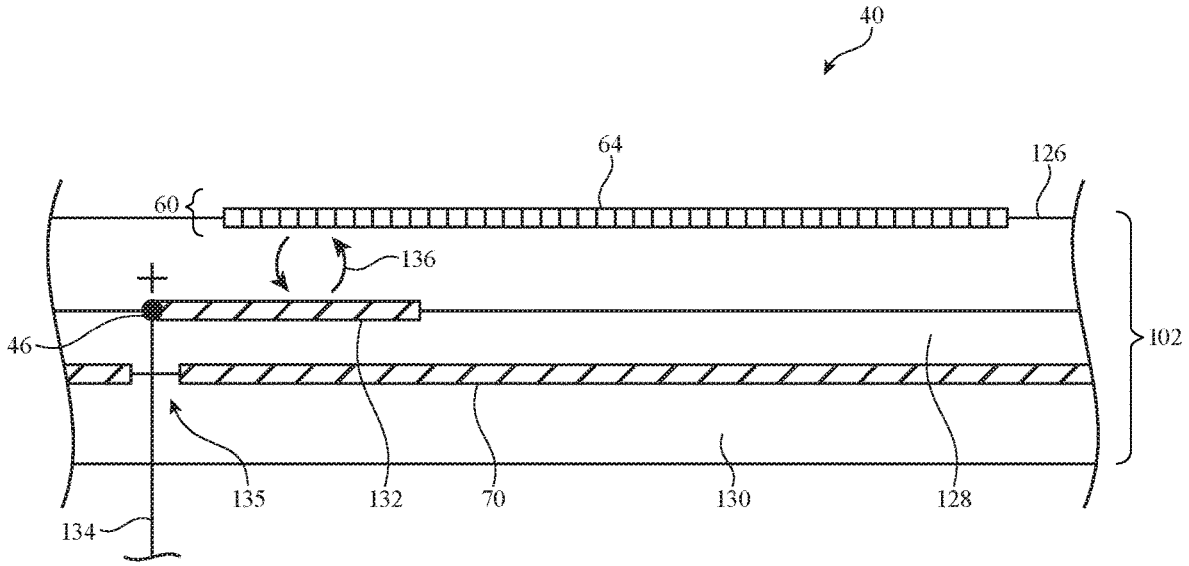
FIG. 11 is a cross-sectional side view showing how an antenna mounted to a display module may be indirectly fed in accordance with an embodiment.

Antenna 40 embedded in substrate 102 may be fed using any desired antenna feed structures. FIGS. 9-11 are cross sectional side views showing how antenna 40 may be provided with different feed arrangements within substrate 102 of FIG. 8. In the example of FIG. 9, antenna 40 is directly fed using a conductive via.

As shown in FIG. 9, conductive layer 60 may be formed on dielectric layer 114 whereas antenna ground 70 is formed on dielectric layer 116 of substrate 102. Dielectric layers 114 and 116 may be different dielectric layers 104 as shown in FIG. 8, for example. This example is merely illustrative and, if desired, additional dielectric layers may be interposed between conductive layer 60 and antenna ground 70.

Grid 64 in conductive layer 60 may form the antenna resonating element for antenna 40 (e.g., patch element 84 of FIG. 6). Grid 64 may be separated from regions 62 of conductive layer 60 that are not used to form part of antenna 40 by gaps such as gap 115. Regions 62 may be used to form pixel circuitry and/or touch sensor electrodes, as an example. An opening such as hole 118 may be formed in antenna ground 70. A conductive through-via such as conductive via 119 may extend through layer 116, hole 118, and layer 114 to positive antenna feed terminal 46 on grid 64. Conductive via 119 may form a part of the signal conductor for the transmission line 44 (FIG. 3) used to feed antenna 40. Feeding antenna 40 using conductive via 119 may allow grid 64 to be located at any desired location within the lateral area of substrate 102 (e.g., grid 64 need not be located at the periphery of substrate 102 to receive radio-frequency signals from the transceiver circuitry).

In the example of FIG. 10, antenna 40 is directly fed using a flexible printed circuit. As shown in FIG. 10, conductive layer 60 may be formed on dielectric layer 122 whereas antenna ground 70 is formed on dielectric layer 120 of substrate 102. Dielectric layers 122 and 120 may be different dielectric layers 104 as shown in FIG. 8, for example. This example is merely illustrative and, if desired, additional dielectric layers may be interposed between conductive layer 60 and antenna ground 70.

Conductive traces on flexible printed circuit 124 may be coupled to positive antenna feed terminal 46 and ground antenna feed terminal 48 of antenna 40. Signal conductor 50 and ground conductor 52 of radio-frequency transmission line 44 (FIG. 3) may be formed from conductive traces on flexible printed circuit 124, for example. Flexible printed circuit 124 may be coupled to a side of substrate 102 and may extend to a main logic board within the interior of device 10. Conductive traces on flexible printed circuit 124 may be used to convey touch signals generated by touch sensor electrodes (e.g., within region 62 of conductive layer 60 or elsewhere in substrate 102) to circuitry on the main logic board. If desired, conductive traces on flexible printed circuit 124 may be used to convey image data to pixel circuitry on substrate 102. In this way, the same substrate (e.g., flexible printed circuit 124) may be used to convey signals for both the display structures and the antenna in substrate 102, thereby optimizing space consumption within device 10.

In the example of FIG. 11, antenna 40 is indirectly fed using an indirect antenna feed element. As shown in FIG. 11, conductive layer 60 may be formed on dielectric layer 126 whereas antenna ground 70 is formed on dielectric layer 130 of substrate 102. At least one dielectric layer such as dielectric layer 128 may be interposed between dielectric layers 126 and 130. Dielectric layers 130, 128, and 126 may be different dielectric layers 104 as shown in FIG. 8, for example.

Additional conductive traces such as conductive trace 132 may be formed on dielectric layer 128. Conductive trace 132 may be formed from ITO, as an example. An opening such as hole 135 may be formed in antenna ground 70. A conductive through-via such as conductive via 135 may extend through layer 130, hole 135, and layer 128 to positive antenna feed terminal 46 on conductive trace 132. Conductive via 134 may form a part of the signal conductor for the transmission line 44 (FIG. 3) used to feed antenna 40.

Antenna currents may be conveyed over conductive via 134 and conductive trace 132. Antenna currents flowing on antenna trace 132 may induce corresponding antenna currents on grid 64 in conductive layer 60 via near-field electromagnetic coupling 136. Similarly, antenna currents generated on grid 64 by received radio-frequency signals may induce antenna currents on conductive trace 132. In this way, conductive trace 132 may indirectly feed the antenna resonating element for antenna 40 (e.g., grid 64). Conductive trace 132 may sometimes be referred to herein as antenna feeding element 132, indirect antenna feed element 132, or antenna feed probe 132. The example of FIG. 11 is merely illustrative. If desired, flexible printed circuit 124 (FIG. 10) may be coupled to positive antenna feed terminal 46 on conductive trace 132.

Figure 12:
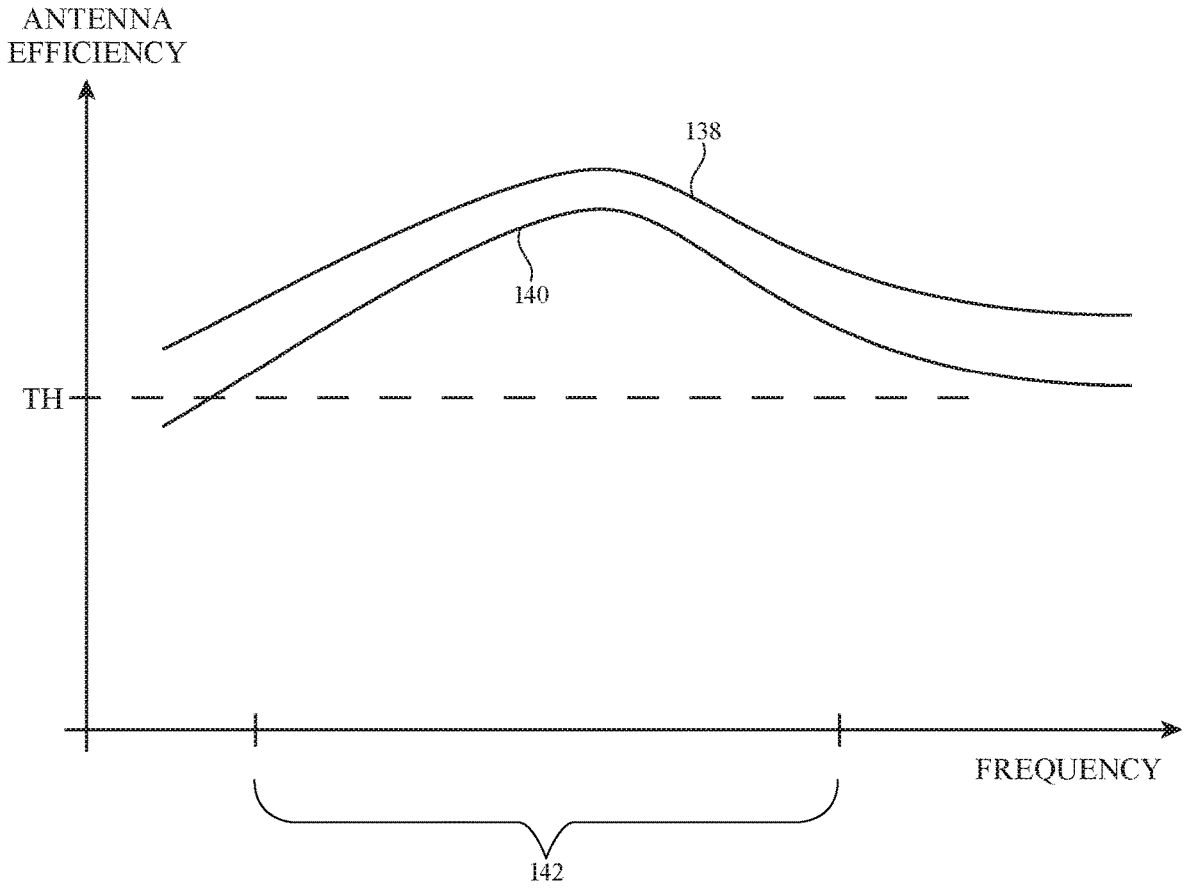
FIG. 12 is a graph of antenna performance (antenna efficiency) for illustrative antennas of the types shown in FIGS. 4-11 in accordance with an embodiment.

FIG. 12 is a graph in which antenna performance (antenna efficiency) of antenna 40 has been plotted as a function of frequency. Curve 138 of FIG. 12 plots the antenna efficiency of an antenna having an antenna resonating element formed from a solid conductor embedded within substrate 102 (FIG. 8). As shown by curve 138, the solid antenna resonating element exhibits a peak response at a frequency within frequency band 142. The antenna efficiency exceeds a minimum antenna efficiency threshold TH across band 142.

Curve 140 plots the antenna efficiency of antenna 40 having a resonating element formed using grid 64 (e.g., as shown in FIGS. 4 and 7-11). As shown by curve 140, forming the antenna resonating element using grid 64 slightly reduces the antenna efficiency across frequency band 142 (e.g., due to the presence of slots 76 as shown in FIG. 5). However, antenna 40 still exhibits a satisfactory antenna efficiency greater than threshold level TH across frequency band 142. As an example, curve 140 may include points that are only between 0 and 5 dB below curve 138. Adjusting the dimensions of grid 64 (e.g., length 80 and/or width 82 of FIG. 5) may tweak curve 140 but, in general, curve 140 may still exceed threshold TH across frequency band 142.

Frequency band 142 may be any desired frequency band such as a GPS band centered at 1575 MHz, a 2.4 GHz WLAN band WL (e.g., extending between about 2400 MHz and 2500 MHz), a 5.0 GHz WLAN band WH (e.g., extending between about 5150 MHz and 5850 MHz), and cellular midband MB (e.g., a band extending between approximately 1700 MHz and 2200 MHz), etc. The example of FIG. 12 is merely illustrative. Antenna 40 may exhibit any desired number of response peaks in any desired frequency bands (e.g., curve 140 may exhibit other shapes).

In this way, antenna 40 may be implemented within device 10 despite the relatively small form factor for device 10 and the presence of adjacent conductive components such as conductive structures used to form housing 12 (FIG. 1). By embedding antenna 40 within display 9 (FIG. 1), antenna 40 may be sufficiently isolated from other electronic components within device 10 and may exhibit satisfactory antenna efficiency across a frequency band of interest. Antenna 40 may be substantially transparent or invisible to the naked eye and may therefore overlap active portions of display 9 if desired. Forming antenna 40 using the same material as display structures in display 9 may simplify manufacturing complexity and minimize cost for manufacturing device 10. Space within device 10 that would otherwise be occupied by antennas (e.g., space outside of display 9) may be used to accommodate any other desired device components.

The foregoing is merely illustrative and various modifications can be made to the described embodiments. The foregoing embodiments may be implemented individually or in any combination.

What is claimed is:

1. An electronic device comprising:

a display having a cover layer and a display module, wherein the display module is configured to display images through the cover layer and comprises a plurality of stacked dielectric layers coupled to the cover layer;

a conductive layer on a surface of a dielectric layer in the plurality of stacked dielectric layers; and an antenna having an antenna resonating element formed from a grid of intersecting conductive traces in the conductive layer, wherein the antenna is configured to transmit radio-frequency signals through the cover layer, the antenna comprises an antenna ground separated from the conductive layer by at least the dielectric layer, an additional conductive layer is formed on an additional dielectric layer in the plurality of stacked dielectric layers, and the antenna ground comprises an additional grid of intersecting conductive traces in the additional conductive layer.

2. The electronic device defined in claim 1, wherein the antenna comprises a positive antenna feed terminal coupled to the grid of intersecting conductive traces.

3. The electronic device defined in claim 2, wherein the grid of intersecting conductive traces comprises a plurality of slots, each slot in the plurality of slots is surrounded by at least some of the intersecting conductive traces in the grid of intersecting conductive traces, and the grid of intersecting conductive traces has edges that define an outline of the antenna resonating element and that surround each of the slots in the plurality of slots.

4. The electronic device defined in claim 3, wherein at least one of the edges has a length approximately equal to one-half of a wavelength of operation for the antenna.

5. The electronic device defined in claim 2, further comprising:

radio-frequency transceiver circuitry; and a conductive via coupled to the positive antenna feed terminal through the dielectric layer, wherein the conductive via is configured to convey the radio-frequency signals from the radio-frequency transceiver circuitry to the positive antenna feed terminal.

6. The electronic device defined in claim 2, further comprising:

radio-frequency transceiver circuitry;

touch sensor electrodes on the display module; and a flexible printed circuit coupled to the display module, wherein the flexible printed circuit comprises:

a first conductive trace coupled to the touch sensor electrodes, and a radio-frequency transmission line coupled between the radio-frequency transceiver circuitry and the positive antenna feed terminal.

7. An electronic device comprising:

a display having a cover layer and a display module, wherein the display module is configured to display images through the cover layer and comprises a plurality of stacked dielectric layers coupled to the cover layer;

a conductive layer on a surface of a dielectric layer in the plurality of stacked dielectric layers;

an antenna having an antenna resonating element formed from a grid of intersecting conductive traces in the conductive layer, wherein the antenna is configured to transmit radio-frequency signals through the cover layer and the antenna comprises an antenna ground separated from the conductive layer by at least the dielectric layer;

radio-frequency transceiver circuitry, wherein the plurality of stacked dielectric layers comprises first and second additional dielectric layers, the first additional dielectric layer is interposed between the dielectric layer and the second additional dielectric layer, and the antenna ground comprises a first conductive trace on the second additional dielectric layer;

a second conductive trace on the first additional dielectric layer; and a conductive via coupled to the second conductive trace through the first and second additional dielectric layers, wherein the conductive via is configured to convey the radio-frequency signals from the radio-frequency transceiver circuitry to the second conductive trace and the second conductive trace is configured to indirectly feed the radio-frequency signals to the grid of intersecting conductive traces via near-field electromagnetic coupling.

8. An electronic device comprising:

a display having a cover layer and a display module, wherein the display module is configured to display images through the cover layer and comprises a plurality of stacked dielectric layers coupled to the cover layer;

a conductive layer on a surface of a dielectric layer in the plurality of stacked dielectric layers; and an antenna having an antenna resonating element formed from a grid of intersecting conductive traces in the conductive layer, wherein the antenna is configured to transmit radio-frequency signals through the cover layer, the grid of conductive traces comprises an array of rectangular openings in the conductive layer, and each of the rectangular openings has edges defined by four respective segments of the intersecting conductive traces from the grid of intersecting conductive traces.

9. The electronic device defined in claim 8, wherein each of the rectangular openings has a length between 0.1 mm and 5 mm.

10. The electronic device defined in claim 9, wherein each of the segments has a width between 0.01 mm and 0.20 mm.

11. The electronic device defined in claim 1, wherein the conductive layer comprises an indium tin oxide (ITO) layer and the grid of intersecting conductive traces comprises a grid of intersecting ITO traces.

12. The electronic device defined in claim 11, wherein the display comprises touch sensor electrodes formed from the ITO layer and the touch sensor electrodes are separated from the grid of intersecting ITO traces by a gap.

13. The electronic device defined in claim 1, wherein the grid of intersecting conductive traces directly contacts the display cover layer.

14. An electronic device comprising:

a first dielectric layer;

a second dielectric layer on the first dielectric layer;

a patch antenna having a patch antenna resonating element, wherein the patch antenna resonating element comprises a grid of conductive traces on the second dielectric layer, the grid of conductive traces defining edges of an array of slots within the patch antenna resonating element;

a ground layer on the first dielectric layer;

a positive antenna feed terminal coupled to the grid of conductive traces; and a ground antenna feed terminal coupled to the ground layer, wherein the ground layer comprises an additional grid of conductive traces on the first dielectric layer, the additional grid of conductive traces defining edges of an additional array of slots within the ground layer.

15. The electronic device defined in claim 14, wherein each slot in the array of slots and each slot in the additional array of slots has a length that is between 0.1 mm and 5.0 mm.

16. The electronic device defined in claim 14, further comprising:

a dielectric cover layer that forms part of an exterior surface of the electronic device, wherein the first and second dielectric layers are mounted to the dielectric cover layer and the patch antenna is configured to radiate through the dielectric cover layer.

17. The electronic device defined in claim 16, further comprising touch sensor electrodes on the first dielectric layer and configured to receive a touch input through the dielectric cover layer.

18. The electronic device defined in claim 17, wherein the grid of conductive traces and the touch sensor electrodes comprise indium tin oxide (ITO).

* * * * *